US006580409B1

(12) United States Patent
Ito et al.

(10) Patent No.: US 6,580,409 B1
(45) Date of Patent: Jun. 17, 2003

(54) DEVICE FOR DRIVING CAPACITIVE LOAD

(75) Inventors: Takeshi Ito, Nagoya (JP); Hideki Saito, Kariya (JP); Toshinori Ninoyu, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/547,678

(22) Filed: Apr. 12, 2000

(30) Foreign Application Priority Data

Apr. 13, 1999 (JP) ..... 11-105640

(51) Int. Cl.[7] ..... G09G 3/30; G09G 3/12

(52) U.S. Cl. ..... 345/76; 345/80; 345/45; 345/36

(58) Field of Search ..... 345/76, 36, 80, 345/44, 45; 315/169

(56) References Cited

U.S. PATENT DOCUMENTS 4,070,663 A * 1/1978 Kanatani et al. ..... 340/324
5,027,040 A 6/1991 Ikeda et al.
5,148,049 A * 9/1992 Okutsu et al. ..... 307/270
5,847,516 A 12/1998 Kishita et al.
5,982,105 A * 11/1999 Masters ..... 315/169

FOREIGN PATENT DOCUMENTS

JP 9-305144 11/1997

OTHER PUBLICATIONS

U.S. patent application Ser. No. 08/855,396, Nishioka et al., filed Jul. 3, 1996.

* cited by examiner

*Primary Examiner*—Steven Saras
*Assistant Examiner*—Alecia D. Nelson
(74) *Attorney, Agent, or Firm*—Rosz & Bethards, PLC

(57) ABSTRACT

A number of capacitive pixels formed in an electroluminescent display panel are selectively charged and discharged by the driving device. The driving device is composed of a charging circuit connected between a power source and the pixels and a discharging circuit connected between the pixels and the ground. Both the charging and discharging circuits include a respective inductive coil that constitutes a series L-C circuit together with the capacitive pixel. Since the pixels are charged and discharged through the series L-C circuit, impulse current otherwise flows in and out of the pixels is suppressed, and thereby radio noises generated by the impulse current are prevented.

1 Claim, 9 Drawing Sheets

DEVICE FOR DRIVING CAPACITIVE LOAD

CROSS-REFERENCE TO RELATED APPLICATION

This application is based upon and claims benefit of priority of Japanese Patent Application No. Hei-11-105640 filed on Apr. 13, 1999, the content of which is incorporated herein by reference.

BACKGROUND OF THE INVENTION

1. Field of the Invention

The present invention relates to a device for driving a capacitive load such as an electroluminescent panel.

2. Description of Related Art

A circuit for driving an electroluminescent panel is disclosed in JP-A-9-305144. This driving circuit includes a circuit for controlling a charging and discharging current of capacitive electroluminescent elements at a constant level (this circuit is referred to as a constant-current circuit). The constant-current circuit prevents an impulse current otherwise supplied to the electroluminescent elements. More particularly, as shown in FIG. 9A attached to this specification, the driving circuit includes a charging circuit 1 and a discharging circuit 2. When an FET 1*a* (a field effect transistor) in the charging circuit 1 turns on according to a control signal-1 fed through a coupling condenser 1*c* and an inverter 1*d*, an electroluminescent element 3 is charged with a voltage VH+ through a resistor 1*b* and the FET 1*a*. On the other hand, when an EFT 2*a* in the discharging circuit 2 is turned on according to a control signal-2 fed through a coupling condenser 2*c*, the electroluminescent element 3 is discharged through the FET 2*a*/and a resistor 2*b*.

As shown in FIG. 9B, the charging current Iel in the above-described circuit abruptly rises upon turning-on of the EFT 1*a*, and the discharging current Iel abruptly flows upon turning-on of the FET 2*a*. A terminal voltage of the electroluminescent element 3 linearly rises up to the voltage level of VH+, the linearly drops down to the level of 0 volt. This means an impulse current flows upon turning-on of the FETS 1*a* and 2*a*. The impulse current generates radio noises though the constant-current circuit controls the charging and discharging current at a constant level after it reaches that level. If the resistors 1*b* and 2*b* are eliminated as shown in FIG. 10A, the charging and discharging current change further abruptly as shown in FIG. 10B. Accordingly, further higher radio noises are generated by the impulse current.

To cope with the problem described above, JP-A-2-256191 (the counter part: U.S. Pat. No. 5,027,040) proposes to insert a coil between the FET 1*a* and the electroluminescent element 3 and another coil between the FET 2*a* and the electroluminescent element 3. Since the coils alleviate sharp rising-up of the impulse current, the radio noises will be reduced. However, coils having large inductance are required to reduce the radio noises in the proposed manner for the following reason. A frequency $f_{el}$ for driving the electroluminescent element in the circuit shown in the above JP-A-2-256191 is determined according to the following formula: $f_{el}(Hz)=1/\{4\pi(LC_{el})^{1/2}\}$, where L is an inductance of the inserted coil, and $C_{el}$, is a capacitance of the electroluminescent element. If $C_{el}$ is 2 (nF), and $f_{el}$ is 400 (Hz), L has to be in the order of 20 (H) to effectively suppress the impulse current. It is, however, difficult to buy such a coil having a large inductance, because such a coil is not available in the usual market.

SUMMARY OF THE INVENTION

The present invention has been made in view of the above-mentioned problem, and an object of the present invention is to provide an improved device for driving a capacitive load such as an electroluminescent panel, in which radio noises are effectively suppressed without using coils having a large inductance.

A driving device of the present invention alternately charges and discharges a capacitive load. The driving device is composed of a charging circuit connected between a power source and the capacitive load and a discharging circuit connected between the capacitive load and a ground. The charging circuit is a series circuit including an inductive coil and a transistor that is turned on or off according to a control signal fed thereto. The charging circuit constitutes a series L-C circuit together with the capacitive load. The discharging circuit is a similar series circuit including an inductive coil and a transistor that is turned on or off according to another control signal fed thereto. The discharging circuit also constitutes a series L-C circuit together with the capacitive load.

The capacitive load is charged through the charging circuit upon closing the charging circuit, while it is discharged through the discharging circuit. An impulse current that otherwise flows into the capacitive load upon turning-on of the transistor in the charging circuit is suppressed by the inductive coil. Similarly, an impulse current otherwise flowing out of the capacitive load upon turning-on of the transistor in the discharging circuit is suppressed by the inductive coil. Since the impulse current flowing in and flowing out of the capacitive load is suppressed, radio noises generated by the impulse current are prevented. A resistor may be additionally inserted in both the charging and discharging circuits thereby to limit the charging and discharging current to a constant level, while suppressing the impulse current by the inductive coil.

An electroluminescent display panel having capacitive pixels may be driven by the driving device of the present invention. The electroluminescent panel is composed of an array of scanning electrodes, an array of data electrodes and electroluminescent layer interposed between both arrays. Pixels are formed at each inter section of both electrodes, and they are alternately charged and discharged by the driving device to selectively activate the pixels. Since the pixels are capacitive elements, they are driven by the driving device of the present invention in the same manner as other inductive loads. The impulse current in charging and discharging is suppressed, and thereby radio noises are prevented.

A diode may be connected in parallel to the inductive coil in the charging circuit to limit a level of the charging voltage imposed on the capacitive load. To supply scanning voltages sequentially and selectively to the scanning electrodes of the electroluminescent panel a thyristor may be connected between the driving device and each scanning electrode.

Other objects and features of the present invention will become more readily apparent from a better understanding of the preferred embodiments described below with reference to the following drawings.

DETAIL DESCRIPTION OF THE PREFERRED EMBODIMENTS

Figure 1:
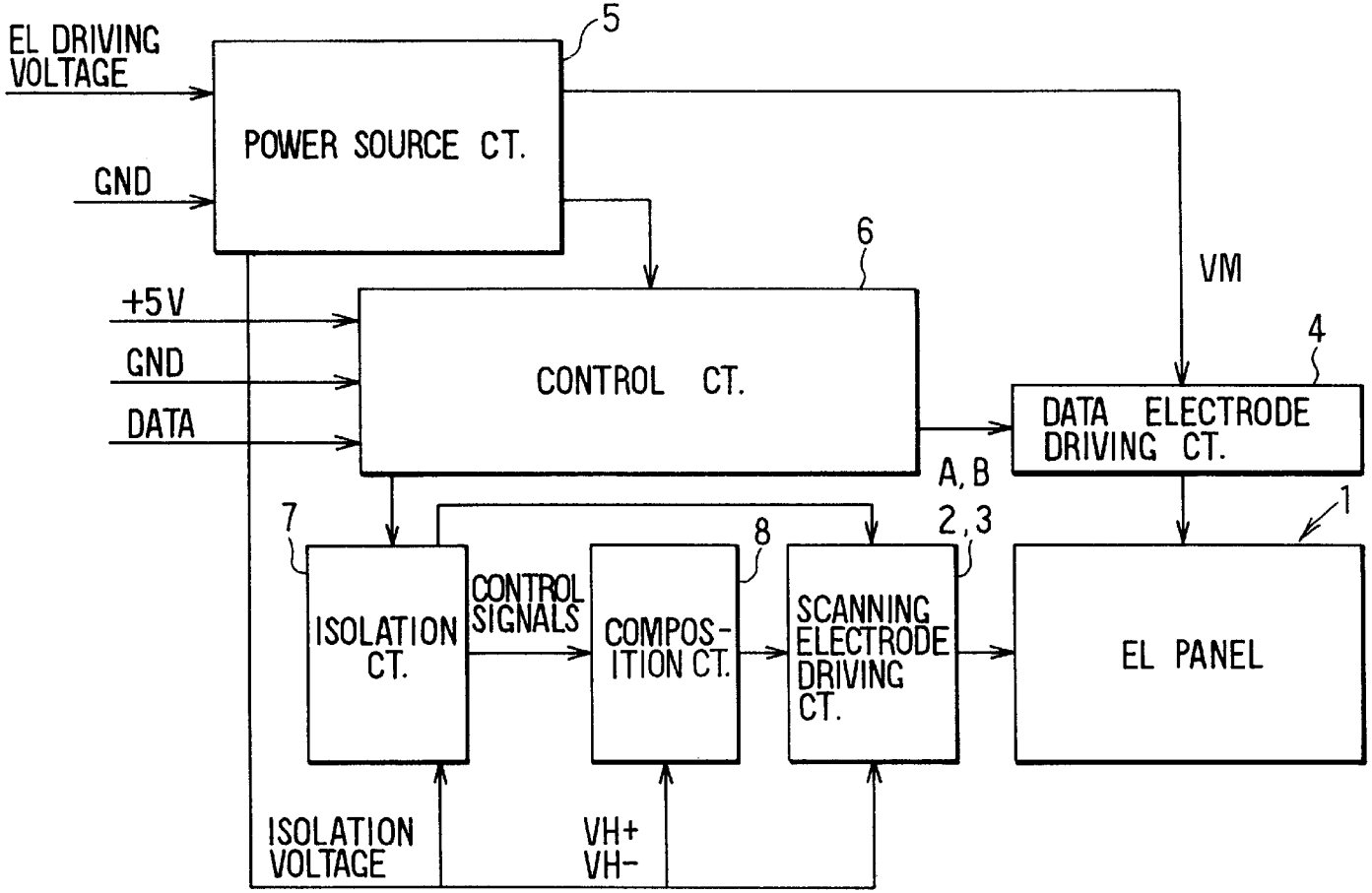
FIG. 1 is a block diagram showing a whole structure of an electroluminescent display device including a driving circuit according to the present invention.

A first embodiment of the present invention will be described in reference to FIGS. 1–6B. First, referring to FIG. 1, the whole structure of an electroluminescent display device will be described. An electroluminescent (referred to as EL) display panel 1 having plural EL elements is driven by scanning electrode driving circuits 2, 3, and a data electrode driving circuit 4. Scanning voltages are fed from a power source circuit 5 through a composition circuit 8 which operates according to signals fed from a control circuit 6 through an isolation circuit 7. Data voltages are supplied to the data electrode driving circuit 4 from the power source circuit 5. Control signals are fed to the data electrode driving circuit 4 from the control circuit 6.

More particularly, the power source circuit 5 provides various voltages supplied to other components, including voltages VH+ and VH− fed to the composition circuit 8, based on an EL driving voltage supplied to the power source circuit 5. The control circuit 6 feeds control signals to the scanning electrode driving circuits 2, 3 through the isolation circuit 7, so that the scanning electrode driving circuits 2, 3 sequentially supply scanning voltages to the scanning electrodes in the display panel 1. The control circuit 6 also feeds control signals A, B to the data electrode driving circuit 4, so that the data electrode driving circuit 4 supplies data voltages to the data electrodes in the display panel 1. The isolation circuit 7 feeds control signals (signal-1–signal-4) to the composition circuit 8 according to control signals supplied from the control circuit 6 and an isolation voltage supplied from the power source circuit 5. The isolation circuit 7 also feeds a control signal for performing the sequential scanning on the scanning electrodes to thyristors in the scanning electrode driving circuits 2 and 3. The composition circuit 8 supplies voltages VH+ and VH− fed from the power source circuit 5 to the scanning electrode driving circuits 2, 3, according to the control signals fed from the isolation circuit 7. The composition circuit 8 will be further described in detail in reference to FIGS. 3 and 4.

Figure 2:
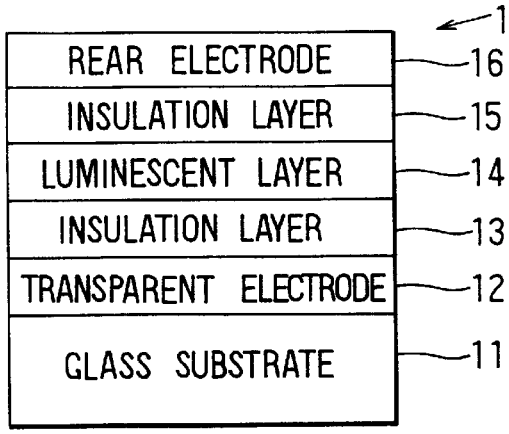
FIG. 2 is a cross-sectional view showing an electroluminescent element in a display panel.

Referring to FIG. 2, the structure of the EL element in the EL display panel 1 will be described. The EL element 1 is composed of multiple layers laminated on a transparent glass substrate 11. A transparent electrode layer 12 forming a scanning electrode, an insulation layer 13, a luminescent layer 14, another insulation layer 15, and a rear electrode layer 16 forming a data electrode are laminated in this order on the transparent glass substrate 11. The luminescent layer 14 emits light upon imposition of alternating pulse voltages across both electrode layers 12 and 16. In this particular embodiment, light is emitted from the transparent glass substrate 11. It is also possible to make the rear electrode layer 16 transparent so that light is emitted from both surfaces of the EL element.

Figure 3:
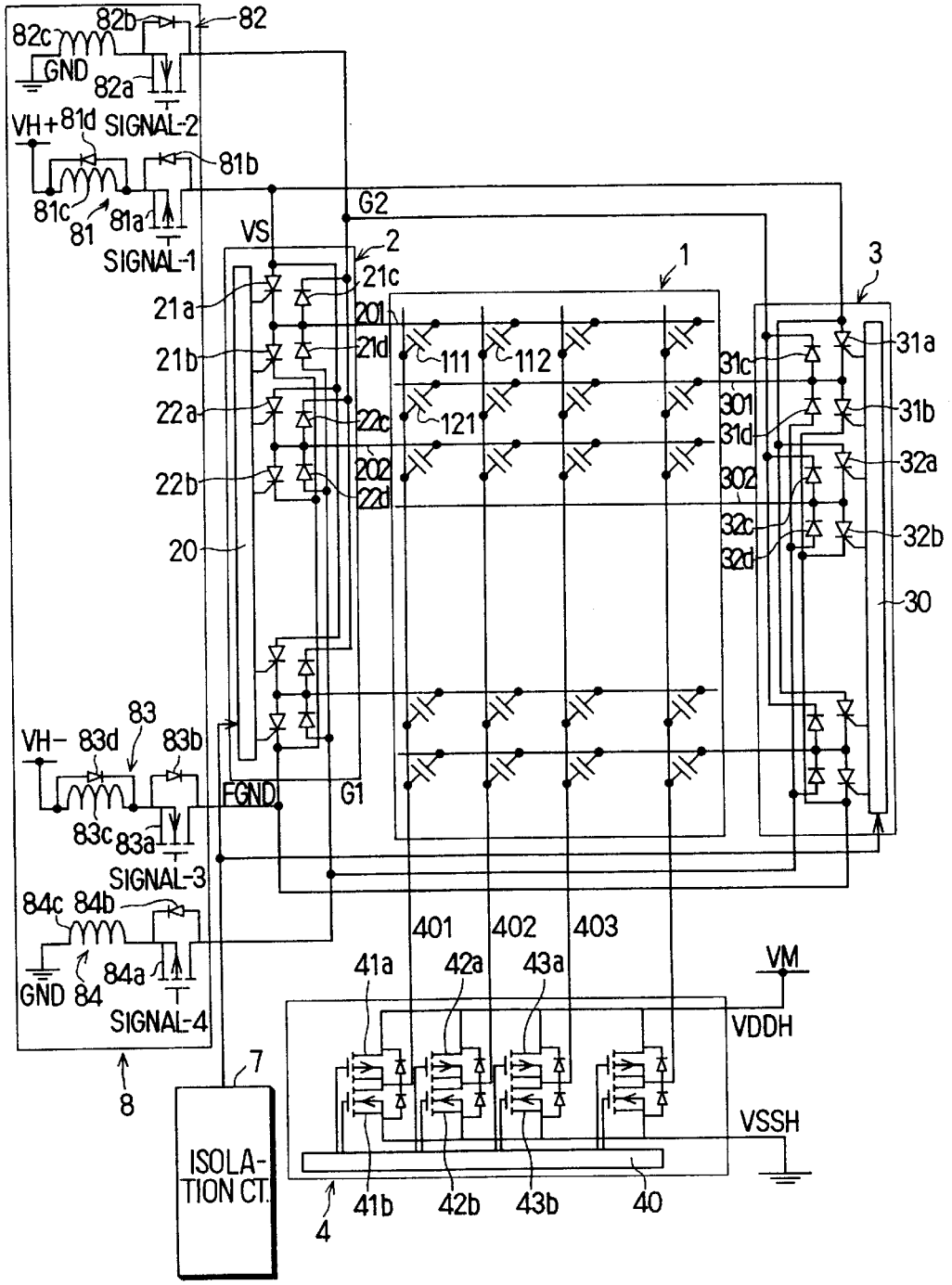
FIG. 3 is a circuit diagram showing the electroluminescent display device as a first embodiment of the present invention.

Now, referring to FIG. 3, the driving circuit of the EL panel 1 will be described. The EL display panel includes plural scanning electrodes (odd-row electrodes) 201, 202 . . . , plural scanning electrodes (even-row electrodes) 301, 302 . . . , plural data electrodes (column electrodes) 401, 402, 402 . . . , and a luminescent layer sandwiched between the scanning electrodes and the data electrodes. The EL elements (pixels) 111, 112 . . . 121 . . . are formed at each intersection of the scanning and data electrodes and arranged in a matrix. Since each EL element is a capacitive element, it is shown as a condenser in FIG. 3. The scanning electrode driving circuit 2 supplies scanning voltages to the odd-row scanning electrodes, while the scanning electrode driving circuit 3 supplies scanning voltages to the even-row scanning electrodes. The data electrode driving circuit 4 supplies data voltages to the data electrodes.

The scanning electrode driving circuit 2 is a push-pull-type driving circuit and includes thyristors (referred to as SCR) 21*a*, 22*a* . . . 21*b*, 22*b* . . . connected to the odd-row electrodes 201, 202 . . . , and a control circuit 20. The thyristors are turned on or off according to the control signals fed from the control circuit 20 and a control signal fed from the isolation circuit 7, and thereby the odd-row scanning electrodes are sequentially scanned. Diodes 21*c*, 21*d*, 22*c*, 22*d* . . . respectively connected to the SCRs 21*a*, 21*b*, 22*a*, 22*b* . . . set a base voltage of the odd-row scanning electrodes to a predetermined level. Similarly, the scanning electrode driving circuit 3 includes thyristors 31*a*, 32*a* . . . 31*b*, 32*b* . . . connected to the even-row electrodes 301, 302 . . . , and a control circuit 30. The thyristors are turned on or off according to the control signals fed from the control circuit 30 and the signal fed from the isolation circuit 7, and thereby the even-row scanning electrodes are sequentially scanned. Diodes 31*c*, 31*d*, 32*c*, 32*d* . . . respectively connected to the SCRs 31*a*, 31*b*, 32*a*, 32*b* . . . set a base voltage of the even-row scanning electrodes to a predetermined level.

The data electrode driving circuit 4 includes P-channel FETs 41*a*, 42*a* . . . , N-channel FETs 41*b*, 42*b* . . . and a control circuit 40, and supplies data voltages to the data electrodes 401, 402, 403 . . . . Parasitic diodes are formed in the respective FETs.

Figure 4:
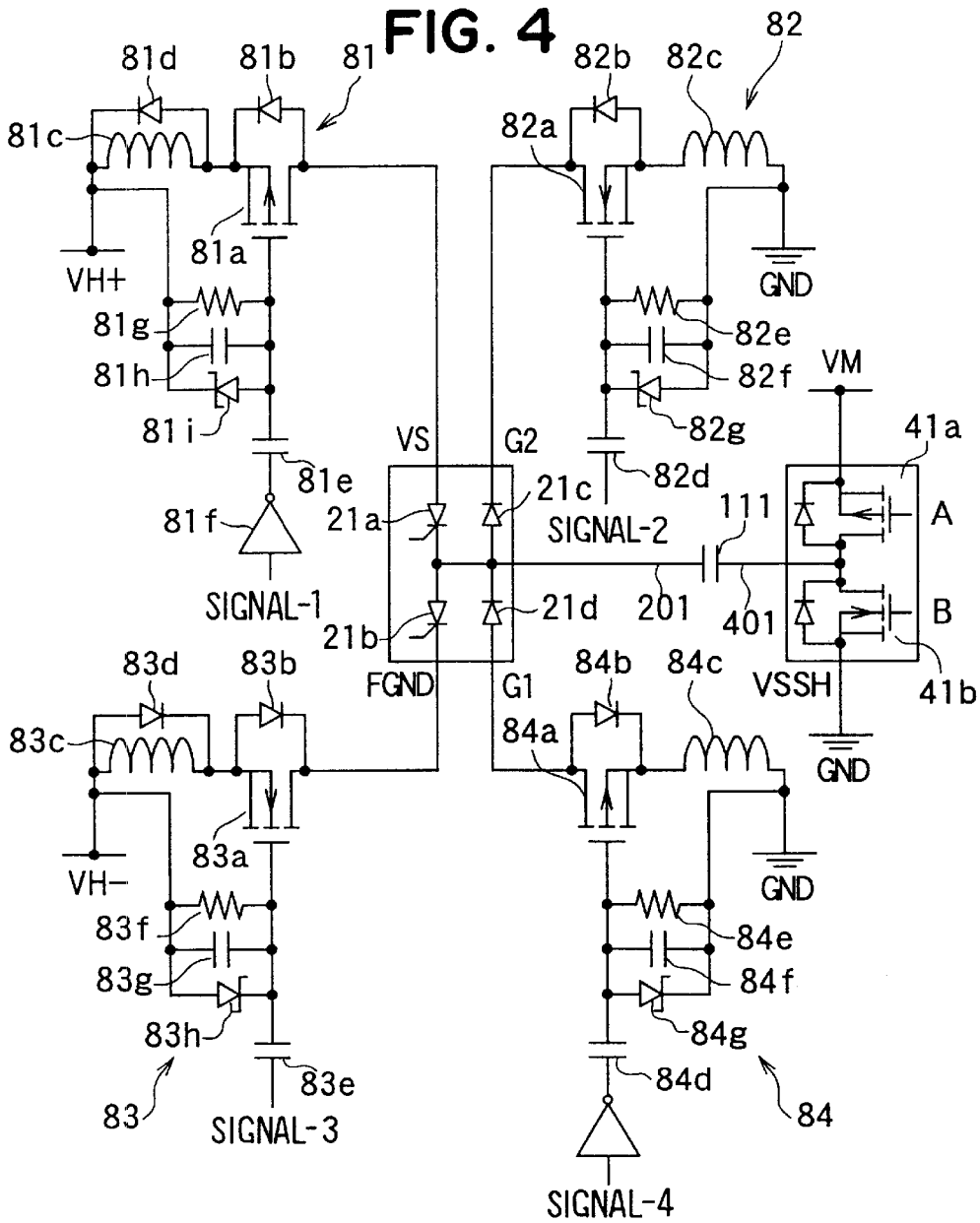
FIG. 4 is a circuit diagram showing in detail a part of a driving circuit including an electroluminescent element in a display panel.

Referring to FIG. 4, details of the composition circuit 8 including two charging circuits 81 and 82, and two discharging circuits 82 and 84 will be described. Though only one EL element 111 is connected to the composition circuit 8 for explanation purpose, other EL elements are similarly connected thereto. The charging circuit 81 has an FET 81*a* which includes a parasitic diode 81*b*. A source terminal of FET 81*a* is connected to the power source circuit 5 through a parallel circuit composed of a coil 81*c* and a diode 81*d*, so that the voltage VH+ (240 V) is supplied to the FET 81*a*. An anode of the diode 81*d* is connected to the source terminal of the FET 81*a*. A drain terminal of the FET 81*a* is connected to an anode of SCR 21*a* (referred to as VS terminal of the scanning electrode driving circuits 2 and 3). A gate terminal of the FET 81*a* is connected to the isolation circuit 7 through a coupling condenser 81*e* and an inverter 81*f*, so that the control signal-1 is fed thereto. A parallel circuit consisting of a resistor 81*g*, a condenser 81*h* for eliminating noises and a Zener diode 81*i*for protecting input is connected between the gate terminal of the FET 81*a* and the VH+ terminal.

The discharging circuit 82 has an FET 82*a* which includes a parasitic diode 82*b*. A source terminal of FET 82*a* is connected to the ground GND through a coil 82*c*. A drain terminal of the FET 82*a* is connected to a cathode of a diode 21*c* (referred to as G2 terminal of the scanning electrode driving circuits 2 and 3). A gate terminal of the FET 82*a* is connected to the isolation circuit 7 through a coupling condenser 82*d*, so that the control signal-2 is fed thereto. A parallel circuit consisting of a resistor 82*e*, a condenser 82*f* for eliminating noises and a Zener diode 82*g* for protecting input is connected between the gate terminal of the FET 82*a* and the ground GND.

The charging circuit 83 has an FET 83*a* which includes a parasitic diode 83*b*. A source terminal of FET 83*a* is connected to the power source circuit 5 through a parallel circuit composed of a coil 83*c* and a diode 83*d*, so that the voltage VH− (−200 V) is supplied to the FET 83*a*. A cathode of the diode 83*d* is connected to the source terminal of the FET 83*a*. A drain terminal of the FET 83*a* is connected to a cathode of SCR 21*b* (referred to as FGND terminal of the scanning electrode driving circuits 2 and 3). A gate terminal of the FET 83*a* is connected to the isolation circuit 7 through a coupling condenser 83*e*, so that the control signal-3 is fed thereto. A parallel circuit consisting of a resistor 83*f*, a condenser 83*g* for eliminating noises and a Zener diode 83*h* for protecting input is connected between the gate terminal of the FET 83*a* and the VH− terminal.

The discharging circuit 84 has an FET 84*a* which includes a parasitic diode 84*b*. A source terminal of FET 84*a* is connected to the ground GND through a coil 84*c*. A drain terminal of the FET 84*a* is connected to an anode of a diode 21*d* (referred to as G1 terminal of the scanning electrode driving circuits 2 and 3). A gate terminal of the FET 84*a* is connected to the isolation circuit 7 through a coupling condenser 84*d* and an inverter, so that the control signal-4 is fed thereto. A parallel circuit consisting of a resistor 84*e*, a condenser 84*f* for eliminating noises and a Zener diode 84*g* for protecting input is connected between the gate terminal of the FET 84*a* and the ground GND.

A junction of the cathode of the SCR 21*a* and the anode of the SCR 21*b* is connected to a junction of the anode of the diode 21*c* and the cathode of the diode 21*d*. The connecting point of both junctions is connected to the EL element 111 through the scanning electrode 201. On the other hand, a junction of a source terminal of the FET 41*a* of the data electrode driving circuit 4 and a drain terminal of the FET 41*b* is connected to the EL element 111 through the data electrode 401. A voltage VM (+40 V) is supplied to a drain terminal of the FET 41*a* (referred to as a VDDH terminal of the data electrode driving circuit 4), and a source terminal of the FET 41*b* (referred to as a VSSH terminal of the data electrode driving circuit 4) is connected to the ground GND.

Figure 5:
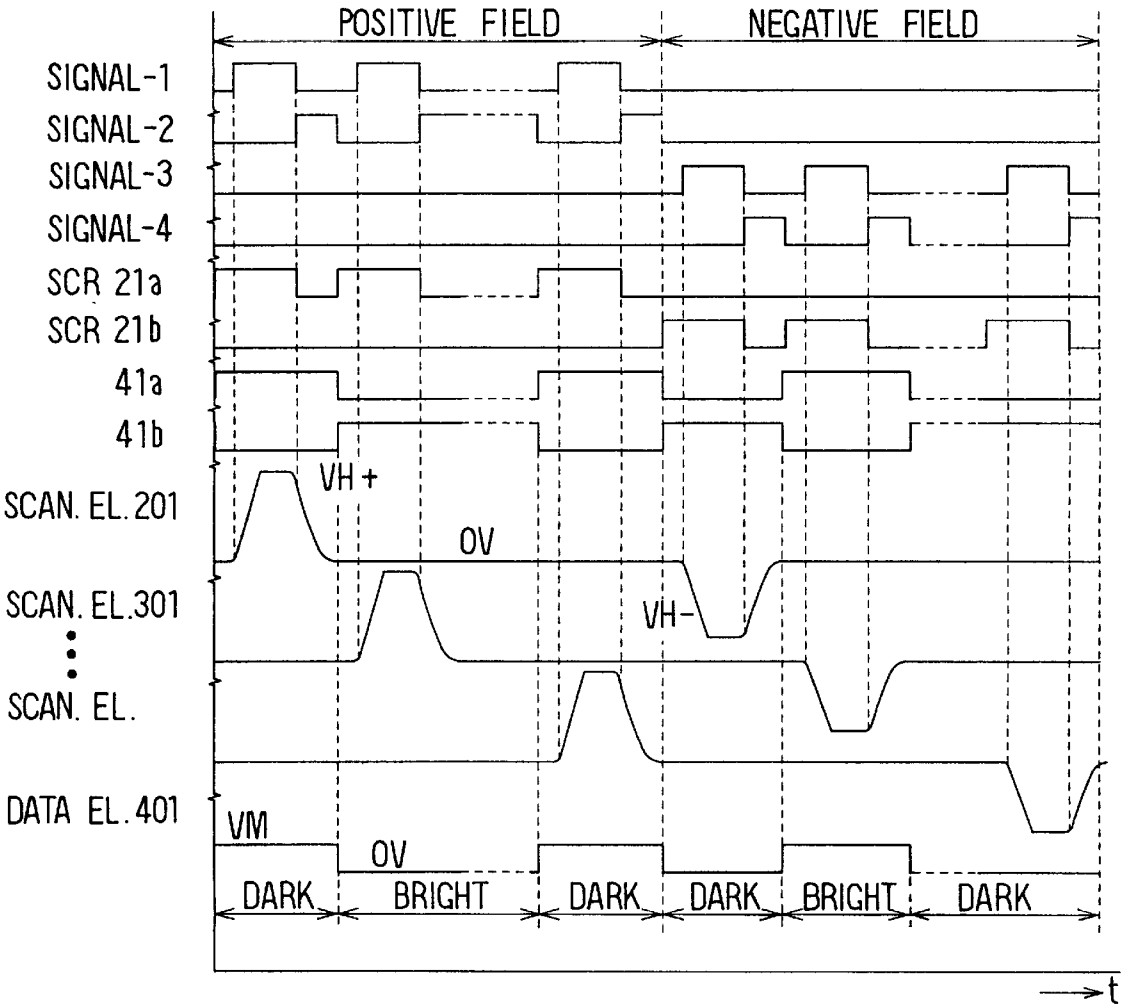
FIG. 5 is a timing chart showing operation of the driving circuit.

Operation of the composition circuit 8 shown in FIG. 4 will be described below in reference to FIGS. 4 and 5. When the EL element 111 is driven in a positive field, the SCR 21*a* is turned on according to the control signal-2, and the FET 81*a* is turned on according to the control signal-1 (having a high level: H). The voltage VH+ (+240 V) is supplied to the EL element through the coil 81*c*, the FET 81*a* and the SCR 21*a*. At this time, when the FET 41*a* of the data electrode driving circuit 4 is turned on by a low level (L) control signal-A fed from the control circuit 6, the voltage VM (+40 V) is supplied to the EL element 111 through the data electrode 401. As a result, a voltage (240−40=200 V) is imposed on the EL element 111, charging it with this voltage. The EL element 111 does not emit light (the EL element is dark) because the imposed voltage 200 V is lower than a threshold voltage. When the FET 41*b* of the data electrode driving circuit 4 is turned on by a high level (H) control signal-B fed from the control circuit 6, the ground voltage (0 V) is supplied to the EL element 111 through the data electrode 401. As a result, a voltage (240−0=240 V) is imposed on the EL element 111, charging it with this voltage. The EL element 111 emits light (the EL element becomes bright) because the imposed voltage 240 V is higher than the threshold voltage.

Then, the control signal-1 becomes L and the control signal-2 becomes H at the same time, and thereby the FET 82*a* is turned on. As a result, the EL element 111 is discharged through the scanning electrode 201, the diode 21*c*, the FET 82*a* and the coil 82*c*, and thereby the voltage imposed on the EL element 111 exponentially decreases.

When the EL element 111 is driven in a negative field, the SCR 21*b* is turned on according to the control signal-2, and the FET 83*a* is turned on according to the control signal-3 (having a high level: H). The voltage VH− (−200 V) is supplied to the EL element 111 through the coil 83*c*, the FET 83*a* and the SCR 21*b*. At this time, when the FET 41*b* of the data electrode driving circuit 4 is turned on by a high level (H) control signal-B fed from the control circuit 6, the ground voltage (0 V) is supplied to the EL element 111 through the data electrode 401. As a result, the EL element 111 does not emit light (the EL element is dark). When the FET 41*a* of the data electrode driving circuit 4 is turned on by a low level (L) control signal-A fed from the control circuit 6, the voltage VM is supplied to the EL element 111 through the data electrode 401. As a result, the EL element 111 emits light (the EL element becomes bright). The absolute value of VH− is the threshold level in the negative field.

Then, the control signal-3 becomes L and the control signal-4 becomes H at the same time, and thereby the FET 84*a* is turned on. As a result, the EL element 111 is discharged through the scanning electrode 201, the diode 21*d*, the FET 84*a* and the coil 84*c*, and thereby the voltage imposed on the EL element 111 exponentially decreases.

Figure 6A:
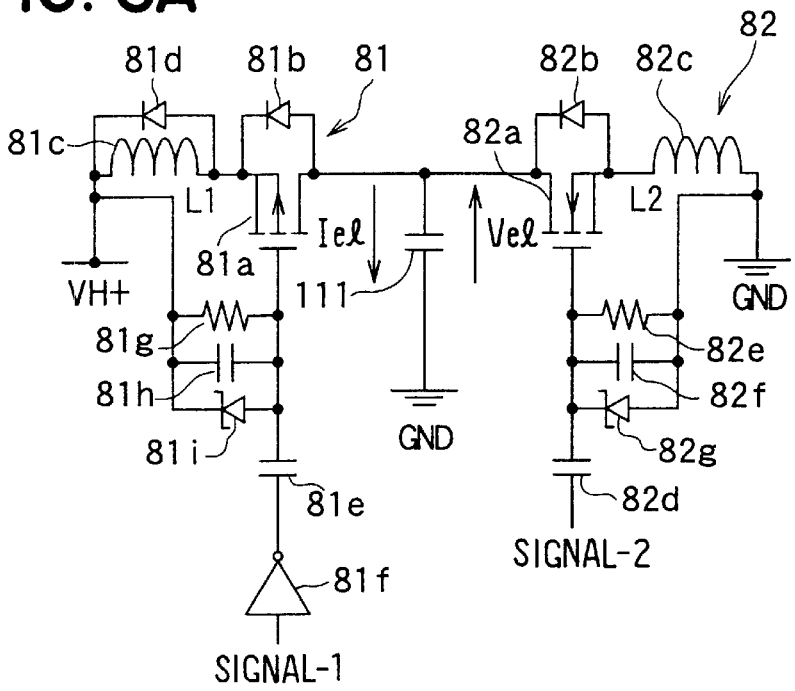
FIG. 6A is a circuit diagram schematically showing a composition circuit for driving an electroluminescent element.
Figure 6B:
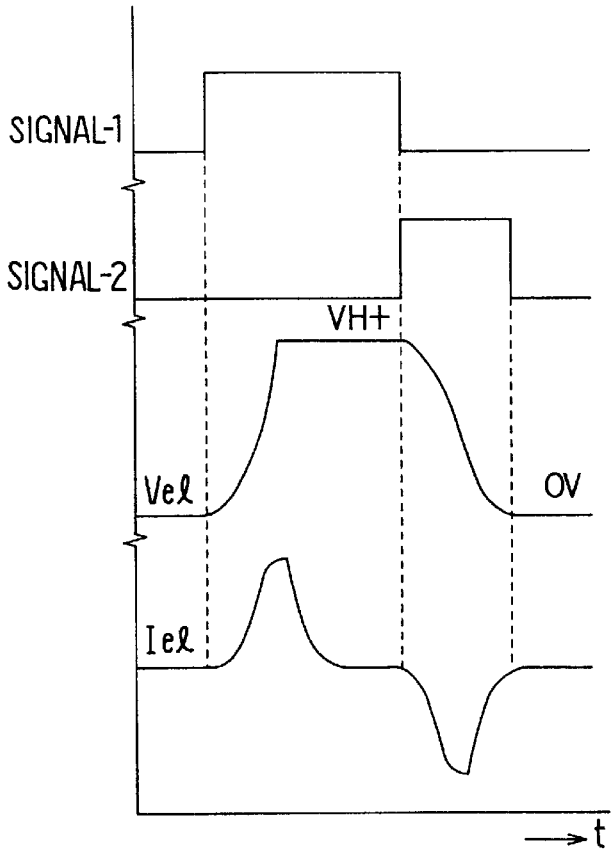
FIG. 6B is a timing chart showing current flowing through the electroluminescent element shown in FIG. 6A and the voltage imposed thereon, together with control signals fed to the composition circuit.

Referring to FIGS. 6A and 6B, the voltage Vel imposed on the EL element 111 and the charging and discharging current Iel of the element will be described. When the FET 81*a* of the charging circuit 81 is turned on, a series L-C circuit of the coil 81*c* having an inductance L1 and the EL element 111 having a capacitance Cel is formed. Since the voltage VH+ is supplied across the L-C circuit, a transient current flows through the coil 81*c*, and a counter voltage is generated in the coil 81*c*. This counter voltage exponentially increases due to the inductance L1. In other words, the EL element is charged by the gradually increasing current Iel, and the voltage Vel imposed on the EL element 111 gradually increases, as shown in FIG. 6B.

Figure 9A:
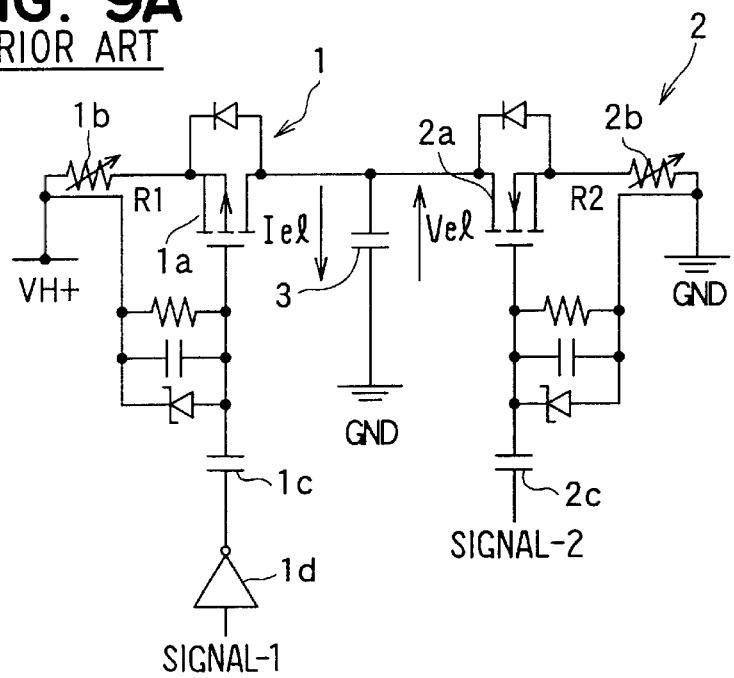
FIG. 9A PRIOR ART
FIG. 9A is a circuit diagram schematically showing a part of a conventional circuit for driving an electroluminescent element.
Figure 9B:
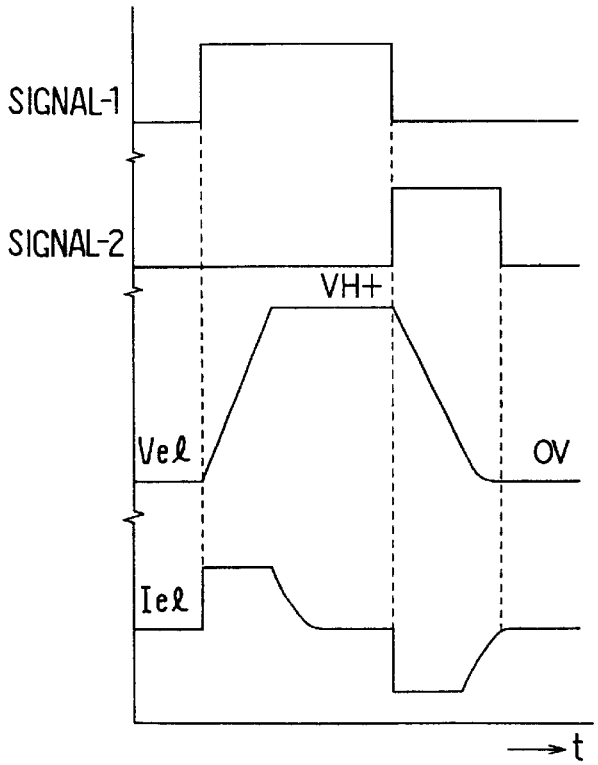
FIG. 9B PRIOR ART
FIG. 9B is a timing chart showing current flowing through the electroluminescent element shown in FIG. 9A and voltage imposed thereon, together with control signals fed to the circuit shown in FIG. 9A.
Figure 10A:
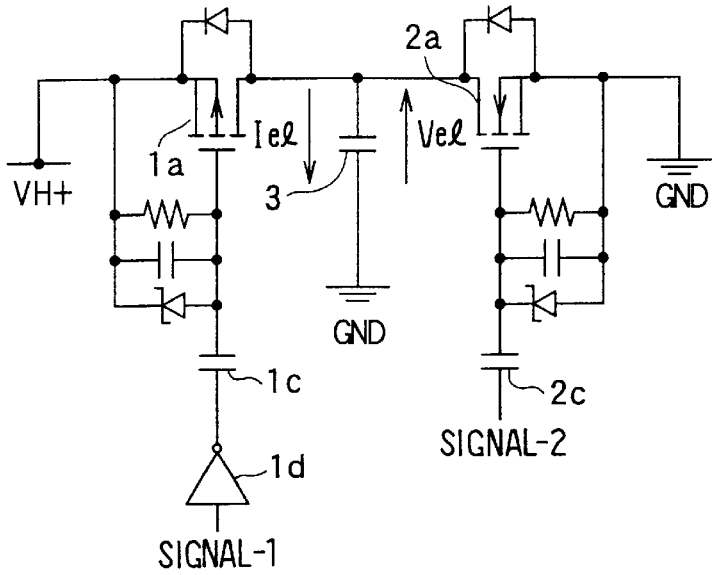
FIG. 10A PRIOR ART
FIG. 10A is a circuit diagram schematically showing a part of another conventional circuit for driving an electroluminescent element.
Figure 10B:
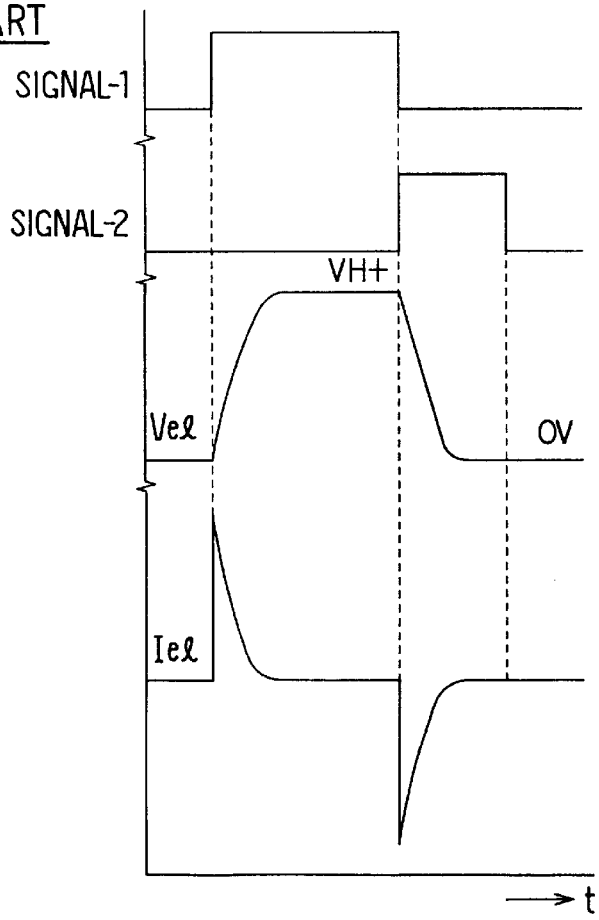
FIG. 10B PRIOR ART
FIG. 10B is a timing chart showing current flowing through the electroluminescent element shown in FIG. 10A and voltage imposed thereon, together with control signals fed to the circuit shown in FIG. 10A.

In this manner, the impulse charging current which flows in the conventional circuit shown in FIGS. 9A and 9B is effectively suppressed, and thereby the radio noises caused by the impulse current is prevented. Further, the driving power is saved because the coil is used in place of the resistor used in the conventional device shown in FIG. 9A. The diode 81*d* connected in parallel to the coil 81*c* functions to prevent the charging voltage from exceeding the driving voltage of the EL element 111, thus avoiding erroneous activation of the EL element 111.

Similarly, when the FET 82*a* of the discharging circuit 82 is turned on, a series L-C circuit composed of an inductance L2 of the coil 82*c* and the capacitance Cel of the EL element 111 is formed. The discharging current Iel and the voltage Vel exponentially decrease due to the inductance L2 and the capacitance Cel, as shown in FIG. 6B. As a result, the impulse discharging current is alleviated, and the radio noises generated by the impulse discharging current are suppressed. Also, power loss caused by the resistor is eliminated because the coil 82*c* is used in place of the resistor used in the conventional device.

As described above, the coil 81*c* is connected between the power source 5 and the FET 81*a*. When the FET 81*a* is turned on and the power source voltage is supplied to the coil 81*c*, a transient counter voltage is generated in the coil 81*c*. The voltage supplied to the FET 81*a* is greatly decreased by the counter voltage, and the current flowing through the series circuit composed of the coil 81*c* and the EL element 111 is suppressed under the characteristics of the FET 81*a*. Therefore, the transient voltage drop in the coil 81*c* is suppressed at a low level, and accordingly a high inductance of the coil 81*c* is not required even if the driving frequency of the EL panel is high. For example, the coil 81*c* having an inductance in a range of several $\mu$H to several tens $\mu$H, which is available in the usual market, sufficiently performs the desired function.

Similarly, the coil 82*c* is connected between the ground and the FET 82*a*. When the FET 82*a* is turned on, a transient counter voltage is generated in the coil 82*c* by the discharging current. The voltage on the FET 82*a* is greatly decreased by the counter voltage, and the current flowing through the series circuit composed of the coil 82*c* and the EL element 111 is suppressed under the characteristics of the FET 82*a*. Therefore, the transient voltage drop in the coil 82*c* is suppressed at a low level, and accordingly a high inductance of the coil 82*c* is not required even if the driving frequency of the EL panel is high. For example, the coil 82*c* having the same inductance as the coil 81*c* in a range of several $\mu$H to several tens $\mu$H, which is available in the usual market, sufficiently performs the desired function. The above-mentioned operation of the charging circuit 81 and the discharging circuit 82 is similarly applied to the charging circuit 83 and the discharging circuit 84.

Figure 7A:
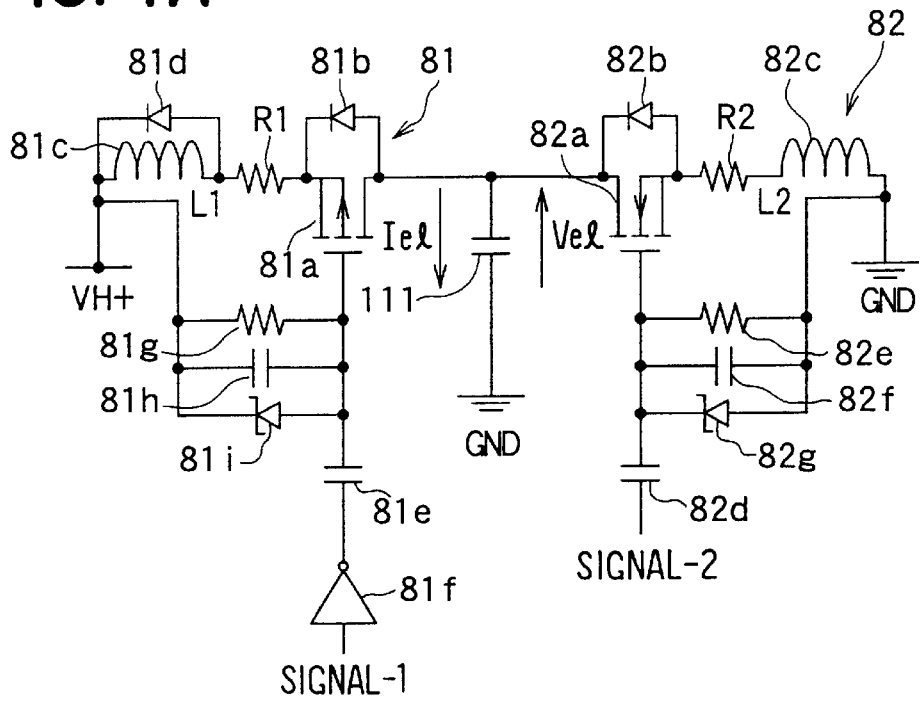
FIG. 7A is a circuit diagram schematically showing a modified form of the composition circuit as a second embodiment of the present invention.
Figure 7B:
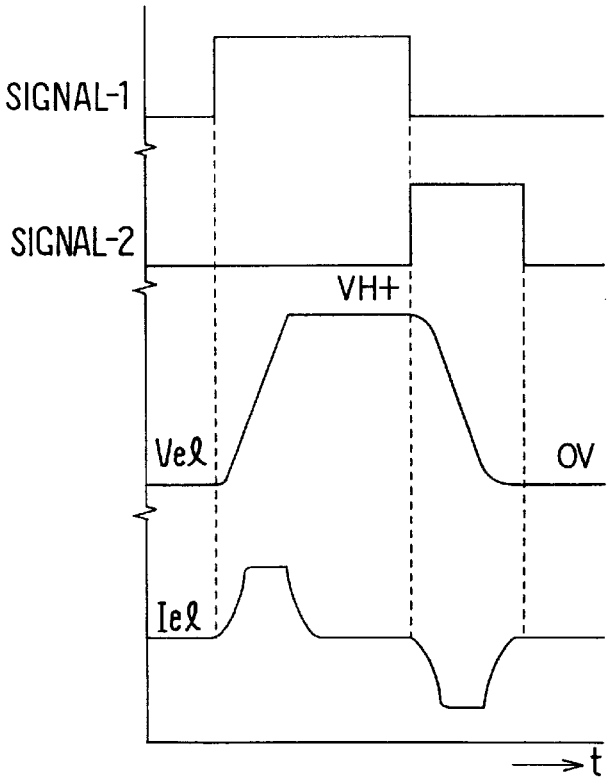
FIG. 7B is a timing chart showing current flowing through the electroluminescent element shown in FIG. 7A and voltage imposed thereon, together with control signals fed to the composition circuit.

A second embodiment of the present invention will be described in reference to FIGS. 7A and 7B. In this embodiment, a resistor R1 is additionally connected between the coil 81*c* and the source terminal of the FET 81*a* in the charging circuit 81, and a resistor R2 is additionally connected between the coil 82*c* and the source terminal of the FET 82*a* in the discharging circuit 82. The additional resistors R1 and R2 are similarly added in the charging circuit 83 and the discharging circuit 84. Other structures are the same as those of the first embodiment.

The charging current is supplied to the EL element 111 through a series circuit composed of the coil 81*c*, the resistor R1 and the FET 81*a*. The charging current is not suppressed as much as in the first embodiment due to the resistor R1 in the series circuit. However, the impulse current is properly suppressed and the charging current is controlled at a constant level, as shown in FIG. 7B. The above-operation is similarly applicable to the discharging circuit 82, and also to other charging and discharging circuits 83 and 84.

Figure 8:
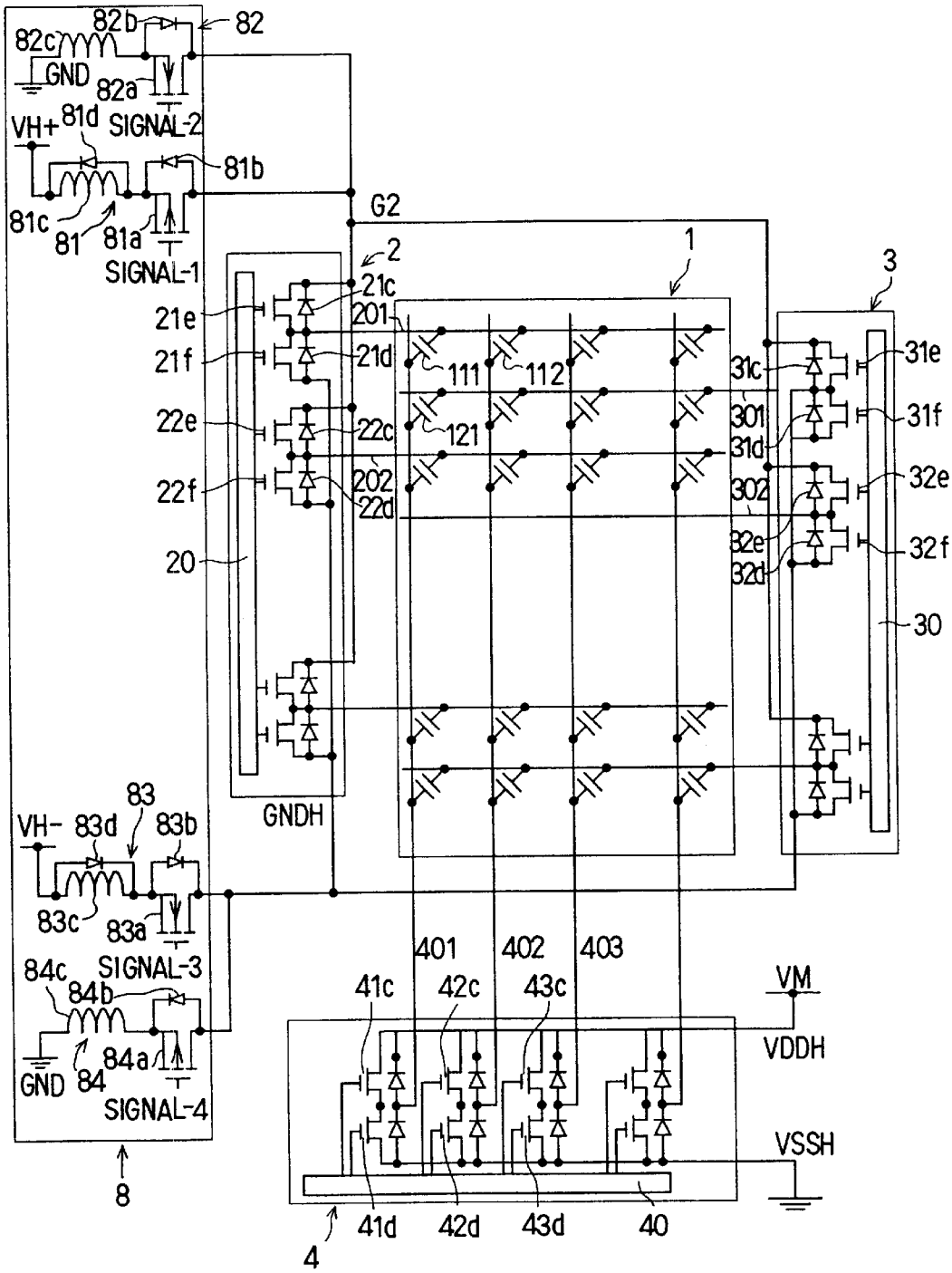
FIG. 8 is a circuit diagram showing a modified form of the electroluminescent device shown in FIG. 3.

FIG. 8 shows a modification applicable both to the first and second embodiments. In this modification, the SCRs 21*a*, 21*b*, 22*a*, 22*b* . . . shown in FIG. 3 are replaced with FETs 21*e*, 21*f*, 22*e*, 22*f* . . . in the scanning electrode driving circuit 2. A drain terminal of the FET 21*e* and a source terminal of the FET 21*f* are commonly connected to the scanning electrode 201. A source terminal of the FET 21*e* is connected to a cathode of the diode 21*c*, and a drain terminal of the FET 21*f* is connected to an anode of the diode 21*d*. A drain terminal of the FET 22*e* and a source terminal of the FET 22*f* are commonly connected to the scanning electrode 202. A source terminal of the FET 22*e* is connected to a cathode of the diode 22*c*, and a drain terminal of the FET 22*f* is connected to an anode of the diode 22*d*.

In the scanning electrode driving circuit 3, SCRs 31*a*, 31*b*, 32*a*, 32*b* . . . are similarly replaced with FETs 31*e*, 31*f*, 32*e*, 32*f* . . . . Other structures are the same as those of the first and second embodiments. The FETs in place of the SCRs similarly operate as the SCRs, and the same advantages of the first and second embodiments are obtained in this modification, too.

The FETs in the charging and discharging circuits of the composition circuit 8 may be replaced with bipolar transistors or IGBTs. Though the EL panel is driven by the driving device of the present invention in the embodiments described above, the driving device is also applicable to other capacitive loads such as batteries or liquid crystal display panels.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A device for driving an electroluminescent display panel, the electroluminescent display panel including a plurality of scanning electrodes, a plurality of data electrodes overlapped on the plurality of the scanning electrodes with a space therebetween and an electroluminescent layer disposed in the space, a plurality of electroluminescent elements being formed at each intersection of the scanning and data electrodes together with the electroluminescent layer, each electroluminescent element constituting a capacitive load and being selectively driven by scanning voltages sequentially supplied to the scanning electrodes with a positive voltage in a positive field and a negative voltage in a negative field and data voltages supplied to the data electrodes in synchronism with the scanning voltages, the driving device comprising:

a first charging circuit connected between a power source and the electroluminescent element, the first charging circuit including a first inductive coil, a first transistor and a first thyristor, all connected in series in this order;

a first discharging circuit connected between the electroluminescent element and a ground, the first discharging circuit including a first diode, a second transistor and a second inductive coil, all connected in series in this order;

a second charging circuit connected between a power source and the electroluminescent element, the second charging circuit including a third inductive coil, a third transistor and a second thyristor, all connected in series in this order; and a second discharging circuit connected between the electroluminescent element and a ground, the second discharging circuit including a second diode, a fourth transistor and a fourth inductive coil, all connected in series in this order, wherein:

the first charging circuit supplies a positive voltage to the electroluminescent element in the positive field to charge the electroluminescent element upon turning-on of both the first transistor and the first thyristor, the first transistor being turned on according to a first control signal fed thereto;

the electroluminescent element is discharged in the positive field through the first discharging circuit upon turning-on of the second transistor, the second transistor being turned on according to a second control signal fed thereto;

the second charging circuit supplies a negative voltage to the electroluminescent element in the negative field to charge the electroluminescent element upon turning-on of both the third transistor and the second thyristor, the third transistor being turned on according to a third control signal fed thereto; and the electroluminescent element is discharged in the negative field through the second discharging circuit upon turning-on of the fourth transistor, the fourth transistor being turned on according to a fourth control signal fed thereto.

* * * * *

UNITED STATES PATENT AND TRADEMARK OFFICE

CERTIFICATE OF CORRECTION

PATENT NO. : 6,580,409 B1 
DATED : June 17, 2003
INVENTOR(S) : Takeshi Ito, Hideki Saito and Toshinori Ninoyu It is certified that error appears in the above-identified patent and that said Letters Patent is hereby corrected as shown below:

Title page,
Item [74], correct the name of *Attorney, Agent, or Firm* "Rosz & Bethards, PLC" to be -- "Posz & Bethards, PLC" --

Signed and Sealed this

Thirtieth Day of September, 2003

JAMES E. ROGAN
*Director of the United States Patent and Trademark Office*